US008910697B1

(12) United States Patent
Dollahan Shirk

(10) Patent No.: US 8,910,697 B1
(45) Date of Patent: Dec. 16, 2014

(54) DRAPERY SYSTEM

(71) Applicant: Linda Dollahan Shirk, Evergreen, CO (US)

(72) Inventor: Linda Dollahan Shirk, Evergreen, CO (US)

( * ) Notice: Subject to any disclaimer, the term of this patent is extended or adjusted under 35 U.S.C. 154(b) by 0 days.

(21) Appl. No.: 13/690,716

(22) Filed: Nov. 30, 2012

(51) Int. Cl.
*E06B 9/36* (2006.01)
*A47H 13/14* (2006.01)

(52) U.S. Cl.
CPC ..... *A47H 13/14* (2013.01)
USPC ..... 160/330; 160/368.1; 160/178.1 V

(58) Field of Classification Search
USPC ..... 160/330, 368.1, 348, 382, 384, 383, 160/398, 404, 340, 341, 167 V, 168.1 V, 160/174 V, 178.1 V, 172 V, 173 V, 176.1 V, 160/177 V; 24/108, 297, 662, 705, 707.5, 24/707.6, 671
See application file for complete search history.

(56) References Cited

U.S. PATENT DOCUMENTS

| | | | | |
|---|---|---|---|---|
| 279,236 | A | 6/1883 | Fletcher | |
| 1,811,619 | A | 6/1931 | Dwyer | |
| 3,080,633 | A * | 3/1963 | Reddy | 24/580.1 |
| 3,084,738 | A * | 4/1963 | Truesdale | 160/330 |
| 3,341,905 | A * | 9/1967 | Gill | 24/105 |
| 3,596,306 | A | 8/1971 | Wachenheimer | |
| 3,682,226 | A * | 8/1972 | Ford | 160/330 |
| 3,688,341 | A * | 9/1972 | Peckham et al. | 16/93 D |
| RE29,979 | E * | 5/1979 | Guebert et al. | 160/330 |
| 4,728,236 | A * | 3/1988 | Kraus | 411/437 |
| 4,874,276 | A * | 10/1989 | Iguchi | 411/48 |
| 4,940,355 | A * | 7/1990 | Buchanan | 403/24 |
| 4,996,752 | A * | 3/1991 | Clendinen | 24/464 |
| 5,193,961 | A * | 3/1993 | Hoyle et al. | 411/553 |
| 5,375,749 | A * | 12/1994 | Oliva | 224/271 |
| 5,428,867 | A | 7/1995 | Hannerstig | |
| 5,540,528 | A * | 7/1996 | Schmidt et al. | 411/55 |
| 5,759,002 | A * | 6/1998 | Essenberg | 411/45 |
| 5,787,954 | A | 8/1998 | Herrera | |
| 5,927,580 | A * | 7/1999 | Ward-Llewellyn | 224/272 |
| 6,098,246 | A * | 8/2000 | Moir | 16/87.2 |
| 6,119,306 | A * | 9/2000 | Antonucci et al. | 16/86 A |
| 6,163,899 | A * | 12/2000 | Leonard | 4/558 |
| 6,334,477 | B1 * | 1/2002 | Moir | 160/168.1 V |
| 6,336,232 | B1 * | 1/2002 | Toder | 4/608 |
| 6,408,927 | B2 | 6/2002 | Kananen et al. | |
| 6,438,796 | B1 * | 8/2002 | Davidson | 16/93 R |
| 6,499,708 | B1 | 12/2002 | Cowen | |
| 6,564,851 | B1 * | 5/2003 | Liao | 160/330 |
| 6,634,693 | B2 * | 10/2003 | Straesser, Jr. | 296/70 |
| 7,174,610 | B2 * | 2/2007 | Rissin et al. | 24/705 |
| 7,337,825 | B1 | 3/2008 | Erbe | |
| 7,536,755 | B2 * | 5/2009 | Nakajima et al. | 24/297 |
| 7,726,922 | B2 * | 6/2010 | Slyter | 411/45 |
| 7,997,323 | B2 * | 8/2011 | Cech | 160/176.1 V |

(Continued)

FOREIGN PATENT DOCUMENTS

| | | |
|---|---|---|
| CN | 201290571 | 8/2009 |
| ES | 2193833 | 11/2003 |
| JP | 2008079959 | 4/2008 |
| JP | 2009082546 | 4/2009 |

*Primary Examiner* — Katherine Mitchell
*Assistant Examiner* — Johnnie A Shablack
(74) *Attorney, Agent, or Firm* — Michael I. Kroll

(57) ABSTRACT

A drapery system comprises a drapery. A drapery track is mounted to a support structure, while a plurality of drapery track carriers slide within the drapery track. A plurality of quick release decorative fasteners releasably retains the drapery to the drapery carriers.

3 Claims, 11 Drawing Sheets

(56) References Cited

U.S. PATENT DOCUMENTS

| | | | | |
|---|---|---|---|---|
| 8,186,023 | B2 * | 5/2012 | Millar et al. | 24/265 H |
| 8,297,335 | B2 * | 10/2012 | Bennett et al. | 160/330 |
| 8,479,800 | B2 * | 7/2013 | Graneto et al. | 160/341 |
| 2010/0156165 | A1 * | 6/2010 | Vais | 297/463.1 |
| 2011/0000630 | A1 * | 1/2011 | Huang | 160/383 |
| 2012/0145860 | A1 * | 6/2012 | Ruffo et al. | 248/251 |

* cited by examiner

DRAPERY SYSTEM

BACKGROUND OF THE INVENTION

1. Field of the Invention

The present invention relates generally to drapery and, more specifically, to a drapery system comprising drapery that is reinforced along it top end with a band of stiffened material allowing the drapery to be folded into undulating longitudinal ripples with the folds extending the length of the drapery.

The band is formed by taking a length of drapery material, at least twice the width of the stiffening material, then placing the stiffened material approximately along one edge of the drapery material then folding the remaining material over the stiffening material forming the band that will be attached along one end of a drapery material forming the top of the drapery. The stiffened fiber material allows the band to be folded into undulating longitudinal waves with the waves extending the drapery band folds through the length of the drapery.

The drapery band further provides a plurality of sequentially spaced grommets that receive a decorative element having a decorative element front portion and one of a mating fastener element on the back side of the decorative element that is mateable to a respective drapery carrier incorporating a fastener receptacle.

Furthermore, the plurality of decorative elements attachment to the plurality of carrier fasteners supporting the drapery therebetween provides a quick means to take down the drapery for cleaning or changing a window treatment that also provides for easily changing the decorative elements to any desired decorative motif.

2. Description of the Prior Art

There are other methods that provide for drapery with folds. While these methods may be suitable for the purposes for which they where designed, they would not be as suitable for the purposes of the present invention as heretofore described.

It is thus desirable to provide a drapery with a reinforced band along the top end of a drapery fabric having a plurality of spaced apart grommeted apertures whereby a plurality of decorative fasteners are then used to fasten said drapery to the drapery track carriers.

It is further desirable to provide a decorative fastener having a decorative portion and a fastener portion with the fastener portion insertable through a respective drapery grommet then fastened to a respective drapery carrier incorporating a fastener receptacle.

SUMMARY OF THE PRESENT INVENTION

A primary object of the present invention is to provide a drapery system for a ripple fold drapery having drapery track carrier fasteners enabling quick mounting and dismounting of the drapery from the drapery track carriers with a drapery track carrier fastener incorporating a decorative member having a frontal decorative portion and a back side fastener portion mateable to the carrier's fastener receptacle.

Another object of the present invention is to provide a drapery system wherein said drapery incorporates a reinforced band along it top end.

Yet another object of the present invention is to provide a drapery system wherein said reinforced drapery band encompasses a strip of stiffened fabric material that provides the wavy rigidity of the drapery header.

Still yet another object of the present invention is to provide a drapery system wherein said stiffened material is preferably buckram.

Another object of the present invention is to provide a drapery system wherein said drapery band further incorporates a plurality of spaced apart grommets.

Yet another object of the present invention is to provide a drapery system having a plurality of decorative elements mateable to the drapery carriers.

Still yet another object of the present invention is to provide a decorative element having a decorative element front portion and a fastener portion on the back side.

Another object of the present invention is to provide a drapery carrier having a fastener receiver mateable to the decorative element fastener.

Yet another object of the present invention is to provide a drapery system wherein the mating fasteners of the decorative element and drapery carrier is selected from the group of snaps, bolt and nut, screw an socket, quarter turn fastener and post and socket.

Still yet another object of the present invention is to provide a drapery system where the decorative element is easily detached from the drapery carrier so that the drapery can be easily attached and detached from the drapery track carriers.

Additional objects of the present invention will appear as the description proceeds.

The present invention overcomes the shortcomings of the prior art by providing a drapery system comprising drapery that is reinforced along it top end with a band of stiffened material allowing the drapery to be folded into undulating longitudinal ripples with the folds extending the length of the drapery with the drapery releasably fastened to drapery track carriers by a decorative element having a decorative element portion on the front side and a fastener portion on the back side that is mateable to a fastener receptacle with each of the drapery carriers.

The foregoing and other objects and advantages will appear from the description to follow. In the description reference is made to the accompanying drawing, which forms a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawing, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWING FIGURES

In order that the invention may be more fully understood, it will now be described, by way of example, with reference to the accompanying drawing in which.

DESCRIPTION OF THE REFERENCED NUMERALS

Figure 1:
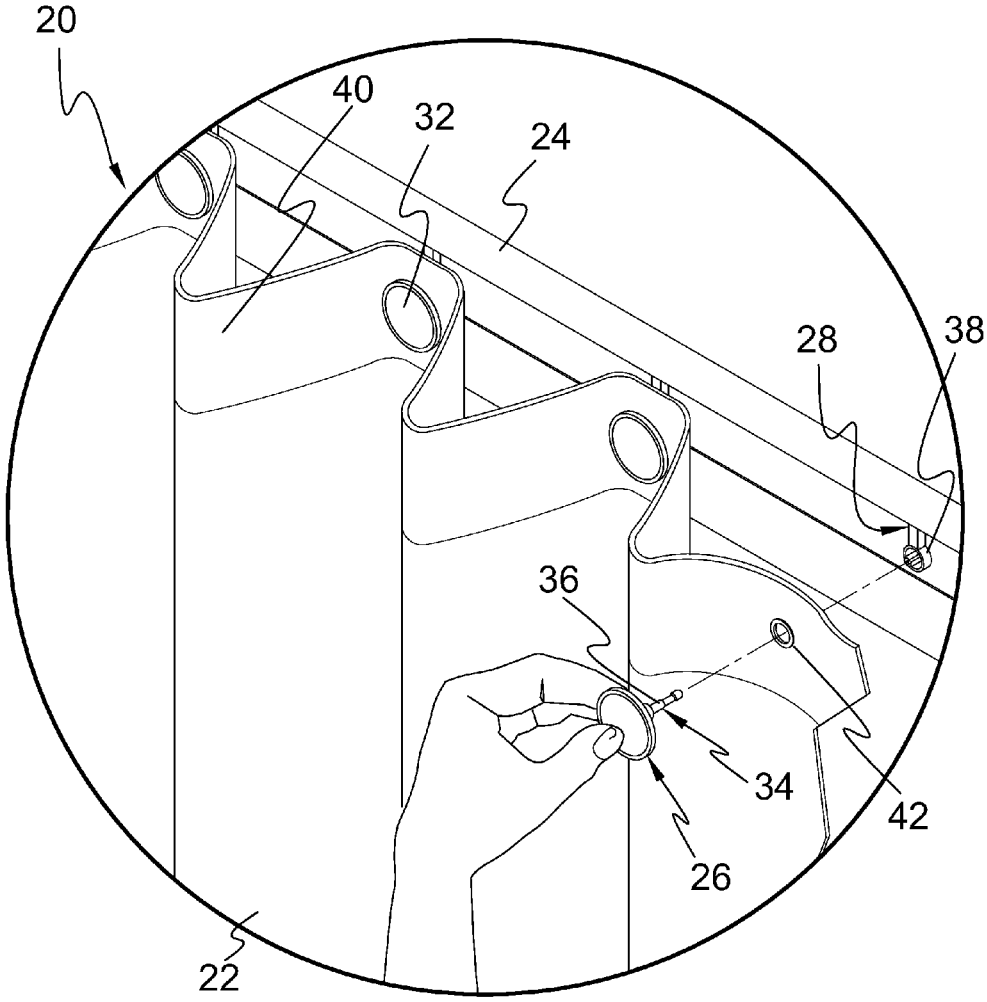
FIG. 1 is an illustrative view of the present invention in use.

Turning now descriptively to the drawings, in which similar reference characters denote similar elements throughout the several views, the Figures illustrate the drapery system of the present invention. With regard to the reference numerals used, the following numbering is used throughout the various drawing figures.

20 drapery system
22 drapery of drapery system 20
24 drapery track of drapery system 20
26 decorative fastener of drapery system 20
28 drapery track carrier of drapery system 20
32 decorative front portion of decorative fastener 26
34 rear fastener portion of decorative fastener 26
36 post for fastener portion 34
38 socket of drapery track carrier 28
40 reinforced drapery band of drapery 22
42 grommet of drapery 22
44 fastener receptacle of decorative fastener 26
46 pliable wing on fastener receptacle 44
48 stem portion of drapery track carrier 28
49 flange on stem portion 48
50 stiffening material of drapery 22
52 screw for fastener portion 34
54 female snap receptacle shaft for fastener portion 34
56 male snap fastener plug for fastener receptacle 44
58 bolt for fastener portion 34
60 nut for fastener receptacle 44
62 quarter turn shaft for fastener portion 34
64 quarter turn retainer for fastener receptacle 44

DETAILED DESCRIPTION OF THE PREFERRED EMBODIMENT

The following discussion describes in detail one embodiment of the invention (and several variations of that embodiment). This discussion should not be construed, however, as limiting the invention to those particular embodiments, practitioners skilled in the art will recognize numerous other embodiments as well. For definition of the complete scope of the invention, the reader is directed to appended claims.

Referring to FIG. 1, shown is an illustrative view of the present invention in use. The present invention is a system 20 and components for the attachment of drapery 22 to a drapery track 24 by a plurality of decorative fasteners 26 mateable to the drapery track carriers 28. Shown is one possible fastener 26 comprising a decorative front portion 32 and a rear fastener portion 34, in this case a post 36, which is mateable to a drapery carrier 28 having a socket 38 for receiving the decorative element post 36. Also shown is a reinforced drapery band 40 having a plurality of grommets 42 for receiving the plurality of decorative elements 26.

Figure 2:
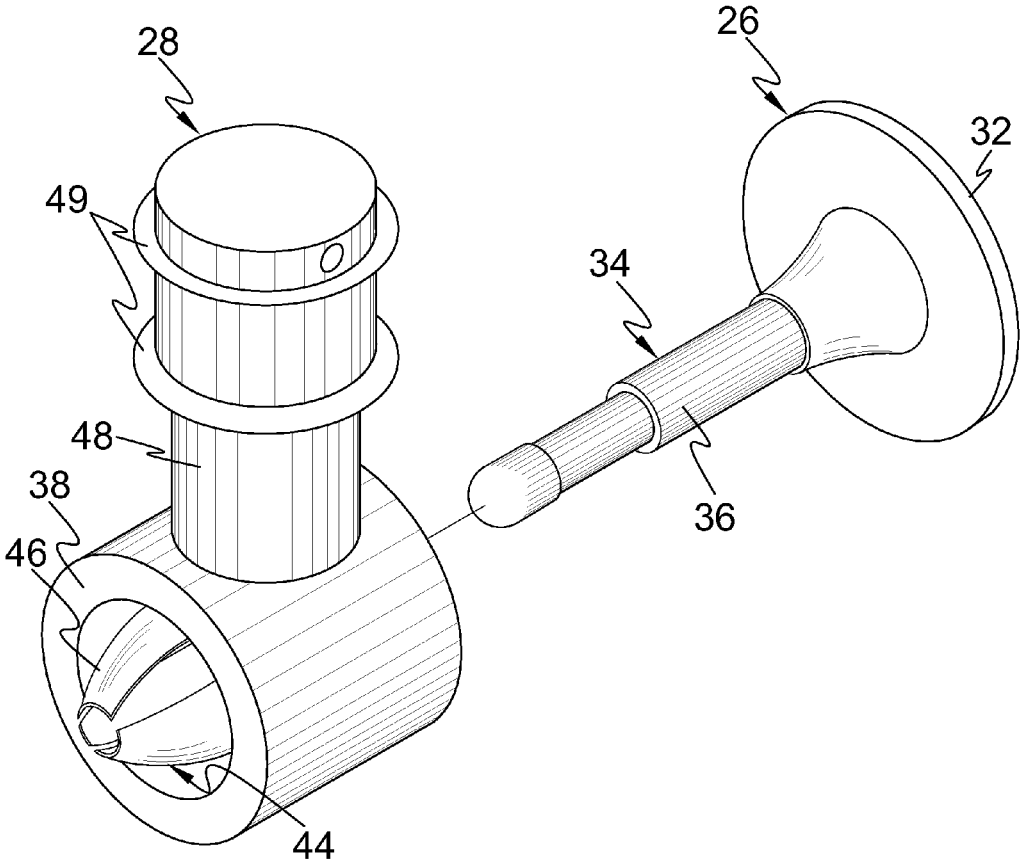
FIG. 2 is a perspective view an enablement of one of the fastening means for attaching the decorative element to the drapery track carrier.

Referring to FIG. 2, shown is an enablement of one of the fastening means for attaching the decorative element to the drapery track carrier. The present invention provides a decorative element 26 having a front side decorative element portion 32 and back side fastener portion 34 that is mateable to a drapery carrier 28 incorporating a fastener receptacle 44. As illustrated, the decorative element 26 has a post 36 and the drapery carrier 28 has a fastener receptacle 44 comprising pliable wings 46 so that the post 36 can be easily inserted during mounting of the drapery 22 and easily detached from the drapery carrier 28 when dismounting the drapery 22.

Figure 3:
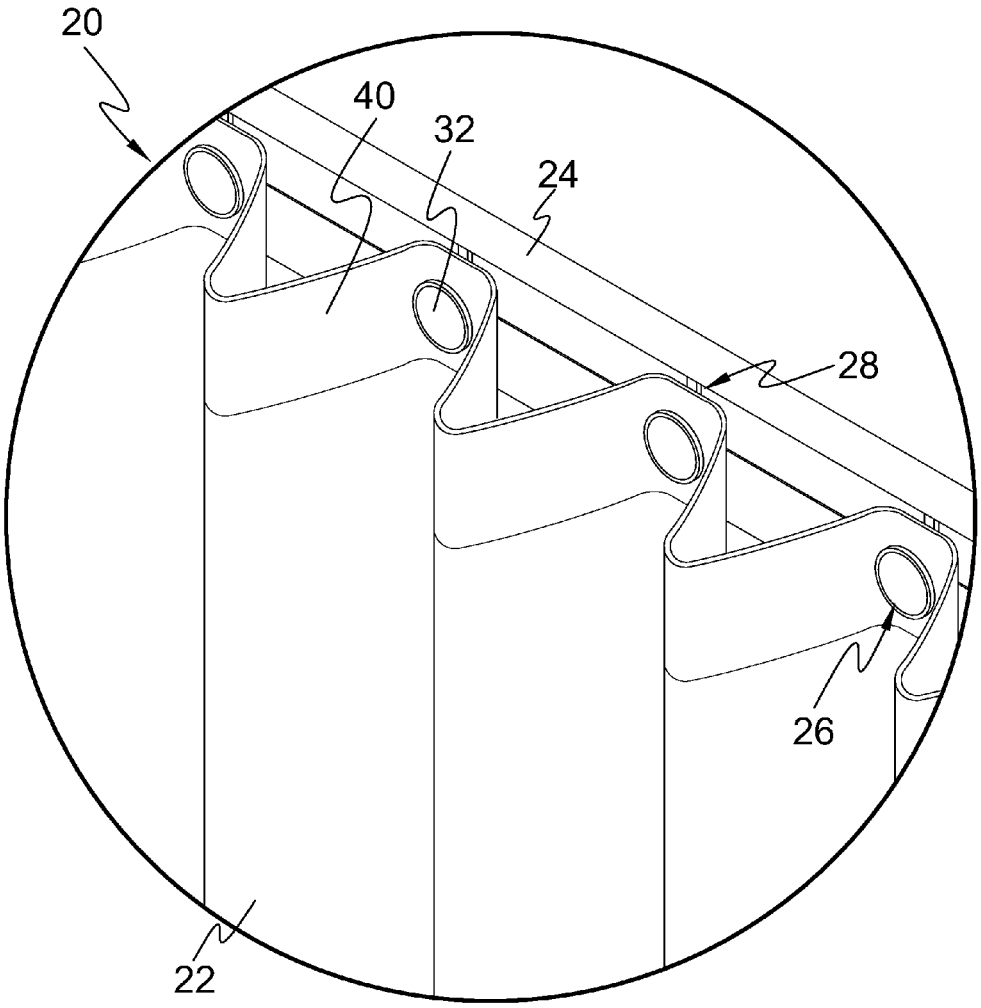
FIG. 3 is an illustrative view of the drapery system of the present invention in use.

Referring to FIG. 3, shown is an illustrative view of the drapery system of the present invention in use. Shown is an assembled illustrated view of the present invention for the attachment of drapery 22 to existing drapery track rail carriers 28 comprising a decorative drapery fastener 30 having a face decorative portion 32 and a backside fastener portion 34 mateable to a drapery carrier fastener receptacle 44. The post 36 is inserted within each carrier fastener receptacle 44 thereby fixedly attached. The decorative element fastener portion 34 is inserted through the drapery band grommet 42 then inserted in the drapery carrier 28 thereby securing the drapery 22 to the drapery track carriers 28.

Figure 4:
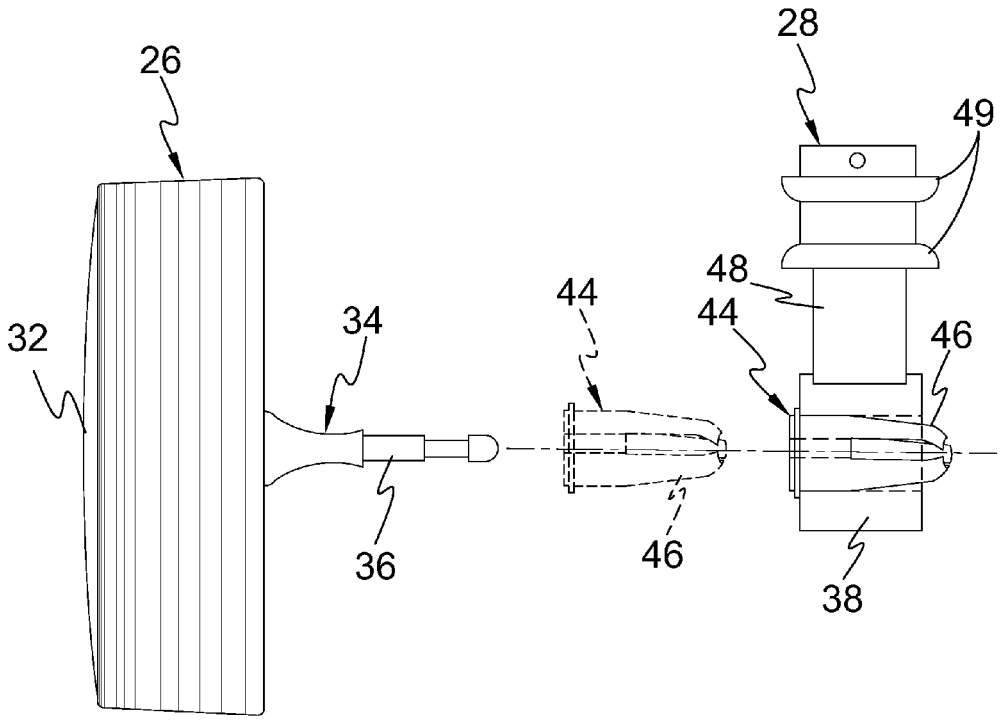
FIG. 4 is an exploded sectional view of the decorative element and drapery carrier.

Referring to FIG. 4, shown is an exploded sectional view of the decorative element and drapery carrier. The drapery carrier 28 of the present invention comprises a stem portion 48 and a docket 38 for the fastener receptacle 44. The stem portion 48 has flanges 49 that ride along the drapery track 24. The distance between the drapery carriers 28 is a design question dependent on the size of the folds desired in the drapery 22. The present invention provides several types of mating fasteners 30. The one illustrated is a post 36 and socket 38. The fastener receptacle 44 has a plurality of pliable wings 46 that will grasp the post 36 of the decorative element fastener 30 when fully seated. The present invention also provides that the drapery carrier fastener receptacle 44 is preferably an integral part of the drapery carrier 28 but may be a separate part insertable into existing sockets 38 of the drapery carriers 28 for the secondary market.

Figure 5:
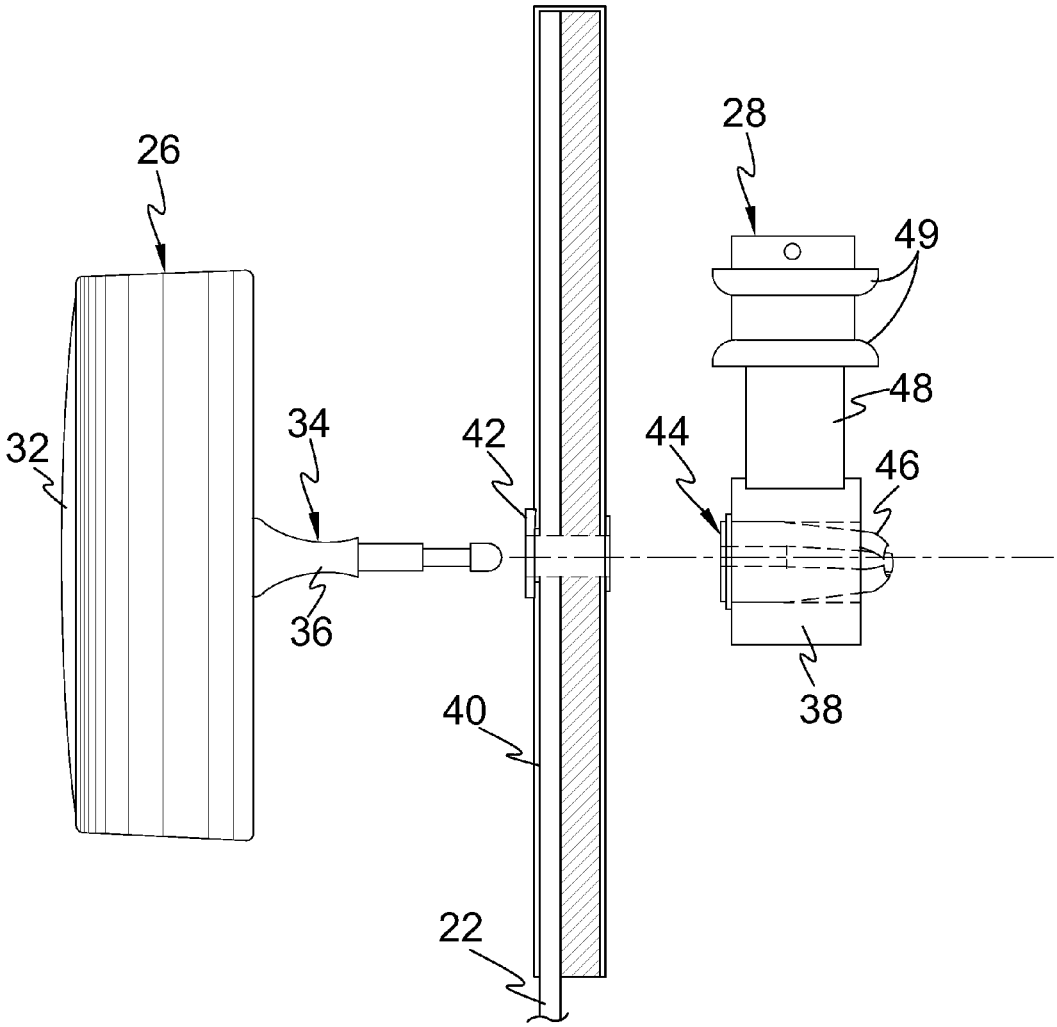
FIG. 5 is an exploded sectional view of the drapery band and fastener elements.

Referring to FIG. 5, shown is an exploded sectional view of the drapery band and fastener elements. Shown is an exploded sectional view of the components for the attachment of drapery 22 having the drapery band 40 incorporating a plurality of grommets 42 for receiving a respective decorative element 26 having a fastener portion 34 that is inserted through a grommet 42 and releasably anchored to a drapery carrier 28 having a fastener receptacle 44.

Figure 6:
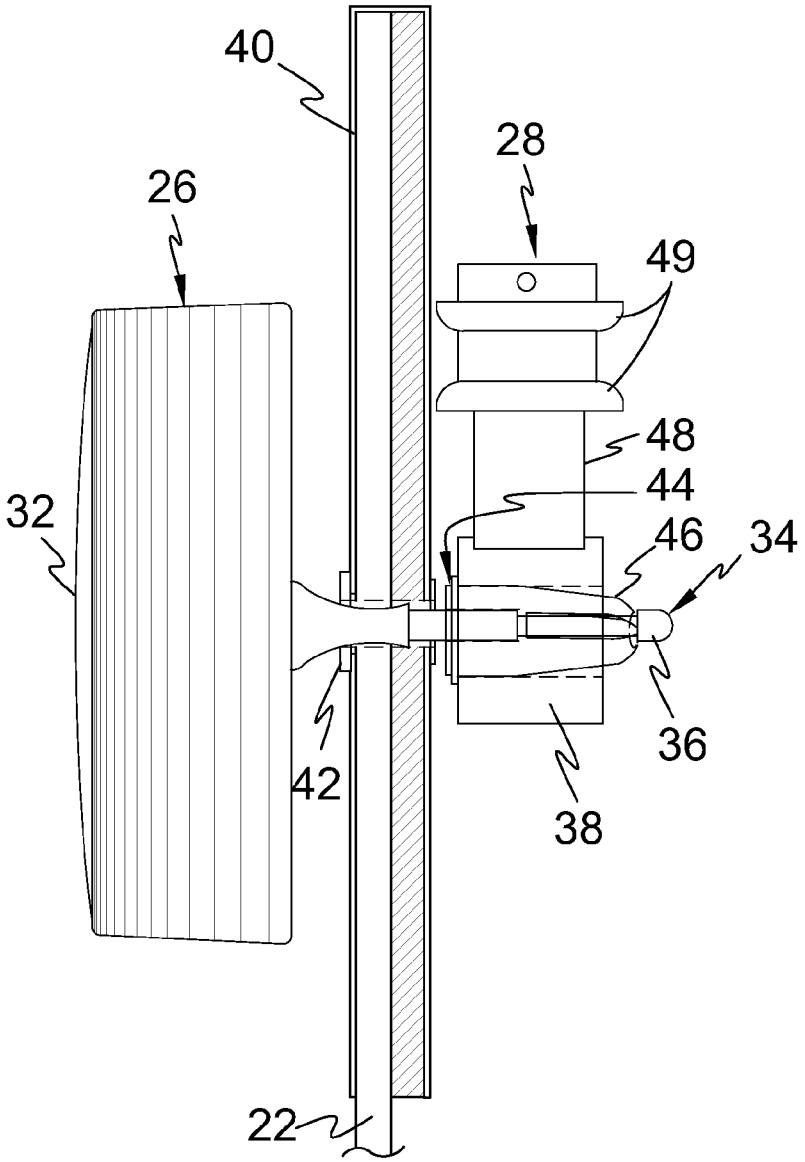
FIG. 6 is an assembled sectional view of the drapery system of the present invention.

Referring to FIG. 6 is an assembled sectional view of the drapery system of the present invention. Shown is a sectional view of the components for the attachment of drapery 22 having the drapery band 40 incorporating a plurality of grommets 42 for receiving a respective decorative element 26 having a fastener portion 34 that is inserted through a grommet 42 and releasably anchored to a drapery carrier 28 having a fastener receptacle 44.

Figure 7:
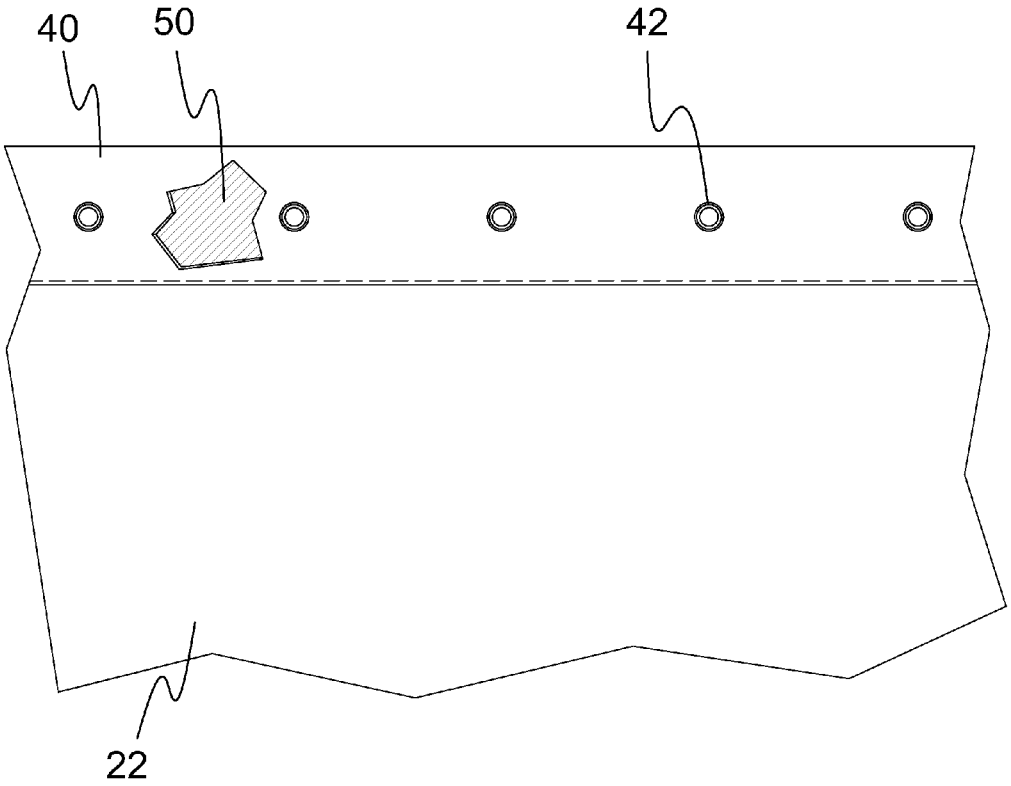
FIG. 7 is a partial cutaway view of the drapery having a band with a stiffening material therein.

Referring to FIG. 7, shown is a partial cutaway view of the drapery having a band with a stiffening material therein. The band 40 is formed by taking a length of drapery material, at least twice the width of the stiffening material 50, then placing the stiffened material 50 approximately along one edge of the drapery material then folding the remaining material over the stiffening material 50 forming the band 40 that will be attached along one end of a drapery material forming the top of the drapery 22. The stiffened fiber material 50 allows the band 40 to be folded into undulating longitudinal ripples with the ripples extending the drapery band folds through the length of the drapery 22. Also shown are a plurality of grommets 42 for receiving the fastener portion 34 of decorative element 26 that is then inserted into a respective carrier 28 having a fastener receptacle 44.

Figure 8:
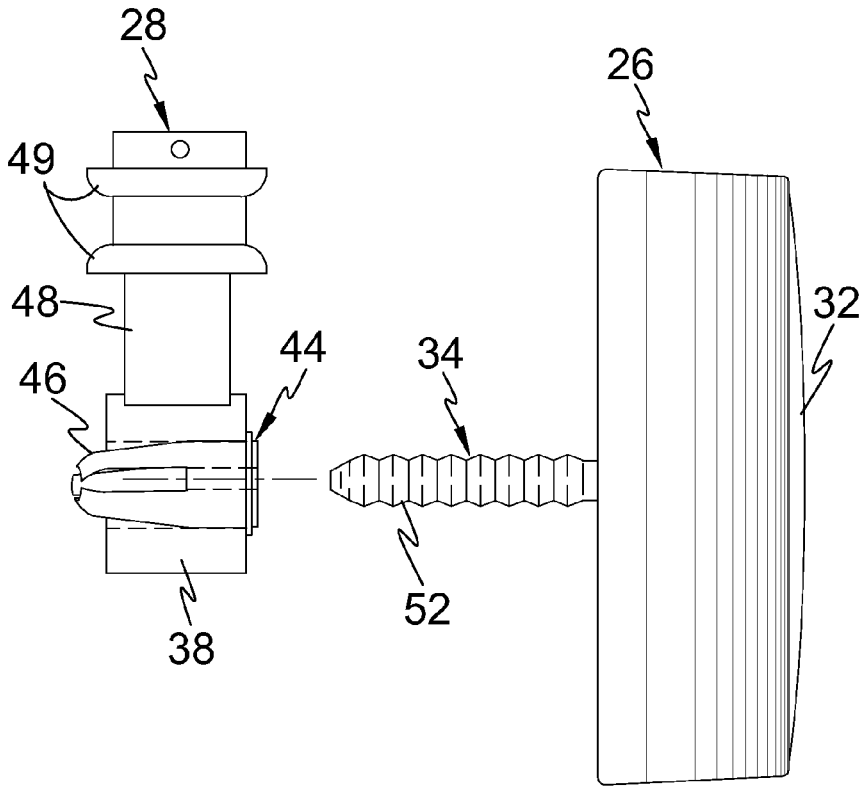
FIG. 8 is a perspective view an enablement of another of the fastening means for attaching the decorative element to the drapery track carrier.

Referring to FIG. 8 is a perspective view an enablement of another of the fastening means for attaching the decorative element to the drapery track carrier. The present invention provides a decorative element 26 having a front side decorative element portion 32 and back side fastener portion 34 that is mateable to a drapery carrier 28 incorporating a fastener receptacle 44. As illustrated, the decorative element 26 has a screw 52 and the drapery carrier 28 has a fastener receptacle 44 comprising pliable wings 46 so that the screw 52 can be easily inserted during mounting of the drapery 22 and easily detached from the drapery carrier 28 when dismounting the drapery 22.

Figure 9:
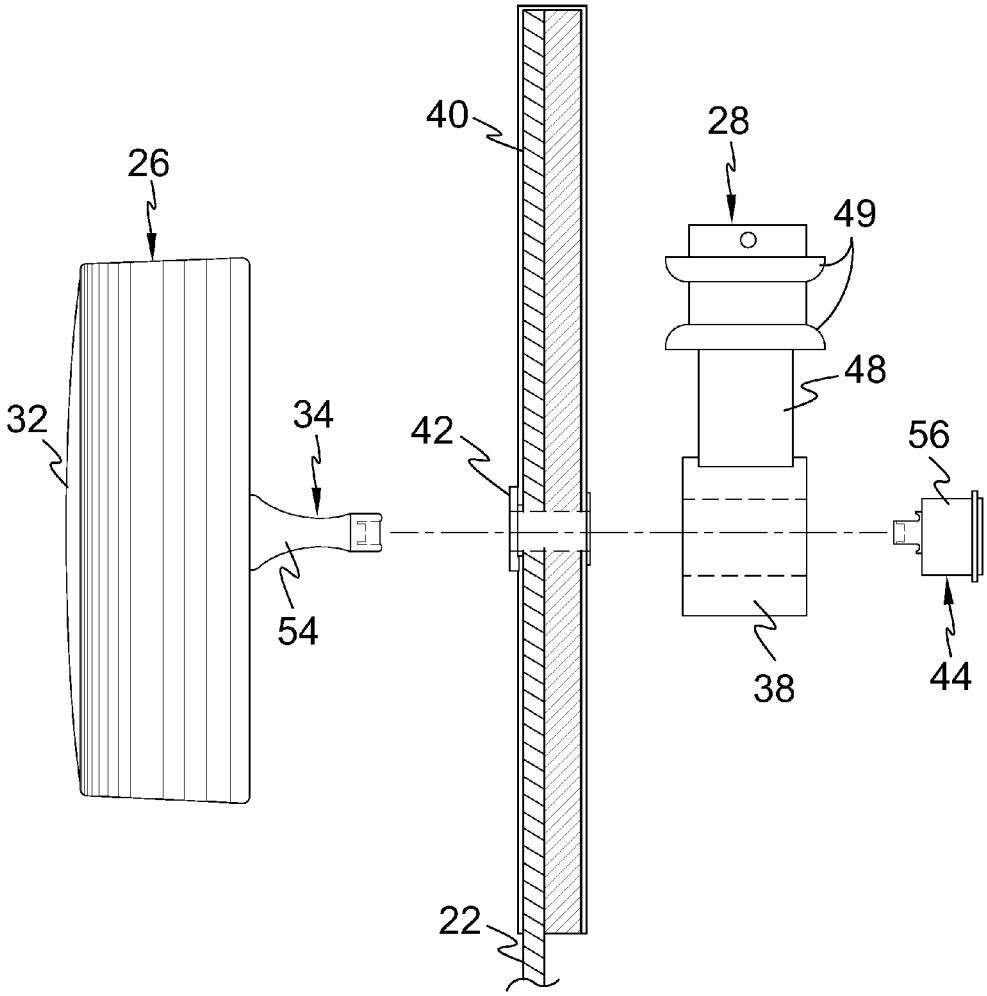
FIG. 9 is a perspective view of an enablement of yet another of the fastening means for attaching the decorative element to the drapery track carrier.

Referring to FIG. 9, shown is a perspective view an enablement of yet another of the fastening means for attaching the decorative element to the drapery track carrier. The present invention provides a decorative element 26 having a front side decorative element portion 32 and back side fastener portion 34 that is mateable to a drapery carrier 28 incorporating a fastener receptacle 44. As illustrated, the decorative element 26 has a female snap receptacle shaft 54 and the drapery carrier 28 has a male snap fastener plug 56 so that the female snap receptacle shaft 54 can be easily inserted during mounting of the drapery 22 and easily detached from the drapery carrier 28 when dismounting the drapery 22.

Figure 10:
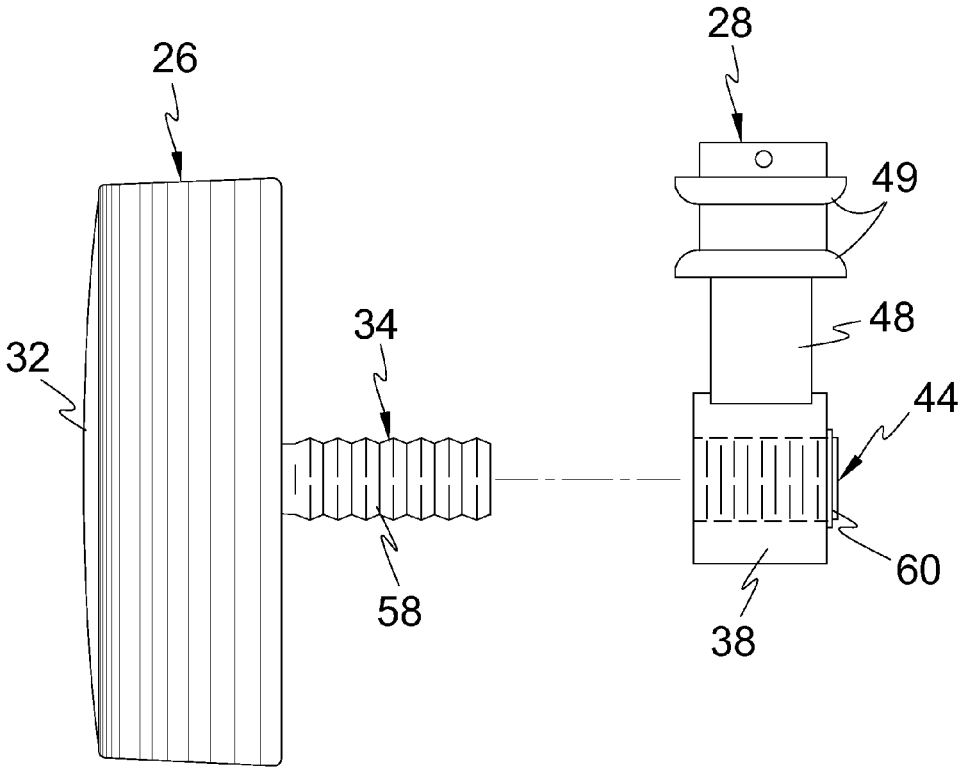
FIG. 10 is a perspective view an enablement of still yet another of the fastening means for attaching the decorative element to the drapery track carrier.

Referring to FIG. 10, shown is a perspective view an enablement of still yet another of the fastening means for attaching the decorative element to the drapery track carrier. The present invention provides a decorative element 26 having a front side decorative element portion 32 and back side fastener portion 34 that is mateable to a drapery carrier 28 incorporating a fastener receptacle 44. As illustrated, the decorative element 26 has a bolt 58 and the drapery carrier 28 has a fastener receptacle 44 comprising a nut 50 so that the bolt 58 can be easily inserted during mounting of the drapery 22 and easily detached from the drapery carrier 28 when dismounting the drapery 22.

Figure 11:
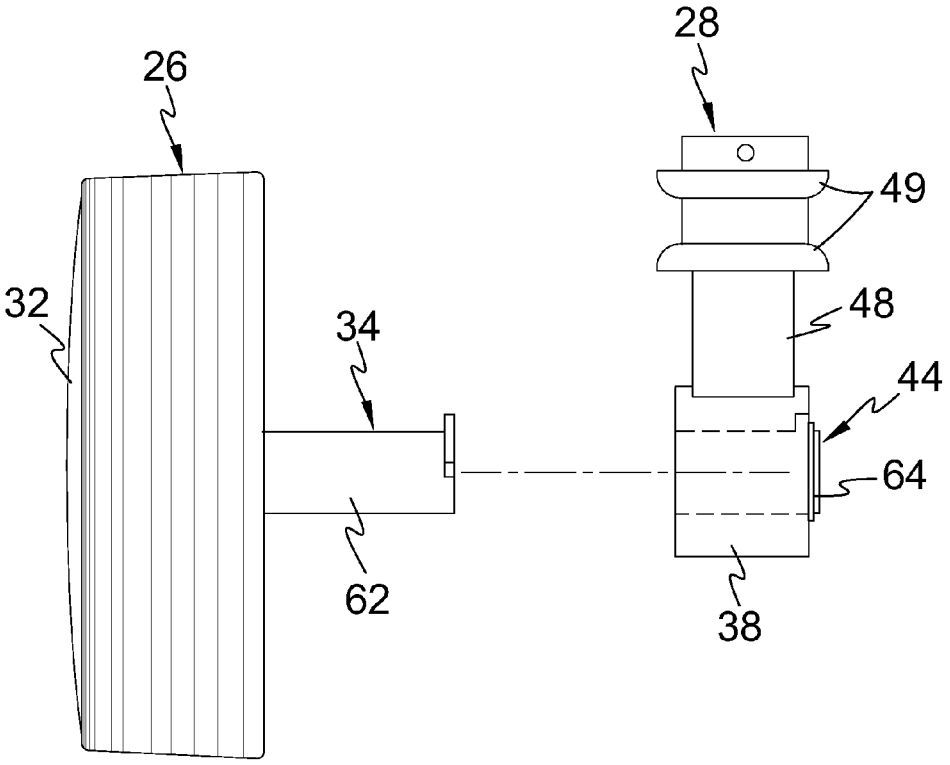
FIG. 11 is a perspective view of an enablement of a further fastening means for attaching the decorative element to the drapery track carrier.

Referring to FIG. 11, shown is a perspective view of an enablement of a further fastening means for attaching the decorative element to the drapery track carrier. The present invention provides a decorative element 26 having a front side decorative element portion 32 and back side fastener portion 34 that is mateable to a drapery carrier 28 incorporating a fastener receptacle 44. As illustrated, the decorative element 26 has a quarter turn shaft 62 and the drapery carrier 28 has a quarter turn retainer 64 so that the shaft 62 can be easily inserted during mounting of the drapery 22 and easily detached from the drapery carrier 28 when dismounting the drapery 22.

What is claimed is:

1. A drapery system which comprises:

a) a drapery having a band of stiffened fabric material along a top end thereof and a plurality of grommets that are equally spaced apart and extend through the drapery band, thereby allowing said band to be folded into undulating longitudinal ripples;

b) a drapery track mounted to a support structure;

c) a plurality of drapery track carriers that slide within the drapery track, each carrier comprising a vertically extending stem portion circular in cross section having spaced flanges completely surrounding said stem portion that ride within the drapery track and a socket transversely affixed to a lower end of the stem portion, said flanges having curved facing surfaces and opposing flat surfaces, a section of said stem portion between said flanges having a diameter greater than a diameter of a section below said flanges, said socket comprising an annular wall forming and fully enclosing a horizontally extending circular opening, wherein said circular opening is perpendicular to a longitudinal axis of said support structure as the carrier slides within the drapery track; and d) a plurality of decorative fasteners to quickly mount the drapery to the drapery carriers and quickly dismount said drapery from said drapery carrier, each decorative fastener comprising a decorative front portion, a rear horizontally extending fastener portion extending from a back surface of the decorative front portion passing through a grommet without hooking thereon, and a fastener receptacle mounted within the circular opening of said socket of said drapery track carrier extending out through a rear of said circular opening, whereby the fastener receptacle slidably engages with and releasably retains the fastener portion therein, whereby said fastener portion is removable without lifting of said decorative fastener and drapery, said horizontally extending fastener portion having a sloped outer surface adjacent a rear wall of said decorative front portion engaging an inner surface of an outer wall of said grommet and not contacting said drapery.

2. The drapery system as recited in claim 1, wherein the fastener portion is comprised of a post and the fastener receptacle includes a plurality of pliable wings to receive and hold the post in place, said post having a bulbous tip for engaging said wings.

3. The drapery system as recited in claim 1, wherein the fastener portion is comprised of a screw and the fastener receptacle includes a plurality of pliable wings to receive and hold the screw in place, said screw not having helical threads.

* * * * *